US006503061B1

(12) United States Patent
Wang

(10) Patent No.: US 6,503,061 B1
(45) Date of Patent: Jan. 7, 2003

(54) DEVICE FOR DISSIPATING HEAT AND CUTTING OFF POWER OF A PUMP

(76) Inventor: Wei-Sheng Wang, No. 67, Te Hsin Road, Tainan (TW)

( * ) Notice: Subject to any disclaimer, the term of this patent is extended or adjusted under 35 U.S.C. 154(b) by 0 days.

(21) Appl. No.: 09/888,548

(22) Filed: Jun. 26, 2001

(51) Int. Cl.[7] ..... F04B 49/10

(52) U.S. Cl. ..... 417/32; 417/366; 277/359; 277/930; 415/176

(58) Field of Search ..... 417/32, 366, 367; 165/47; 277/359, 319, 930, 943, 405; 415/176, 178, 174.3, 230

(56) References Cited

U.S. PATENT DOCUMENTS 4,746,269 A * 5/1988 Raab ..... 415/170 R
4,776,759 A * 10/1988 Maskell et al. ..... 415/170
5,293,929 A * 3/1994 Smith ..... 165/47
6,325,377 B1 * 12/2001 Williamson et al. ..... 266/317

* cited by examiner

*Primary Examiner*—Charles G. Freay
*Assistant Examiner*—Han L. Liu
(74) *Attorney, Agent, or Firm*—Rosenberg, Klein & Lee

(57) ABSTRACT

A heat dissipating and power cutting-off device of a pump has a heat dissipating ceramics ring fitted in a plastic member to form watertight connection in between to prevent water from flowing to a motor. The plastic member has a pivotal hole for a main blade wheel connected to a shaft of the motor, and for a shaft seal tightly fitted in same and said ceramics ring. The ring has an annular trench forming between on outer and an inner annular portions for increasing contact area with water so that heat passing through said ring can be dissipated to prevent plastic member from getting melted by said heat. A power cutting-off member is connected to the motor, and has a sensing element abutting the ceramics ring to sense a temperature of same for activation of the cutting-off member when a racing of the motor occurs to cause temperature of both the motor and the ring to rise.

2 Claims, 6 Drawing Sheets

DEVICE FOR DISSIPATING HEAT AND CUTTING OFF POWER OF A PUMP

BACKGROUND OR THE INVENTION

The present invention relates to a device for dissipating heat and cutting off power of a pump, which can resist relatively high temperature, and automatically cut off the power of the pump when the pump has been racing to cause the temperature of the pump to rise beyond a certain amount due to lack of water.

Referring to FIG. 5, a conventional pump 3 has a motor 31, a shaft center 311, a main shaft 33, a fixing member 32, a protecting member 34, a ceramics ring 341, a rear sealing cover 35, a shaft seal 361, a main blade wheel 36, an O-shaped ring 381, a middle cover 37, a single phase valve 371 and a main body 38.

The shaft center 311 sticks out on the center of the front end of the motor 31 for passing on movement to the main shaft 33, which is connected to the shaft center 311. The fixing member 32 is stationary. The motor 31 is fixedly connected to one side of the fixing member 32 from the front end.

The protecting member 34 and the rear sealing cover 35 are fixedly connected to the fixing member 32. The main blade wheel 36 is disposed next to the front side of the rear sealing cover 35. The shaft seal 361 is passed through the rear sealing cover 35, the protecting member 34 and the main blade wheel 36. The main shaft 33 is passed through the sealing cover 361 to connect the main blade wheel 36 by means of a screw 362 so that the main blade wheel 36 can turn together with the main shaft 33 when the motor is running. The middle cover 37 and the single phase valve 371 are disposed next to the main blade wheel 36 in the main body 38, which is connected to the rear sealing cover 35 with the O-shaped ring 381 being disposed in between for sealing up the joint therebetween.

The shaft seal 361 is tightly passed into the protecting member, and will not turn together with the main blade wheel 36 so water will not flow to the motor 31 when the main blade wheel 36 turns to pump water. The protecting member 34 is made of soft plastic materials so that same and the ceramics ring 341 passed into the protecting member 34 have watertight connection. The shaft sealing cover 361 is tightly passed into the protecting covering 34 as above mentioned, and further tightly passed into the ceramics rings 341 from the front end portion so that water won't flow through the joints to the motor 31 to damage the same.

The motor 31 will cause high temperature in running and the large amount of heat will pass through the shaft seal 361 and the main blade wheel 36, and is dissipated by water pumped into the pump. The ceramics ring 341 is disposed between the protecting member 34 and the front end portion of the shaft seal 361 mainly because it has relatively good conductivity and heat resisting ability to dissipate heat for preventing the plastic protecting member 34 from being melted by the large amount of heat.

However, the conventional pump with the heat dissipating ceramics ring still has drawbacks as follows:

1. The motor will race due to lack of water, and produce a large amount of heat, which can not be dissipated because there is no enough flowing water in contact with the main blade wheel. Consequently the large amount of heat will pass through the plastic protecting member and the rear sealing cover to damage same.

2. When the plastic protecting member is melted, water will flow through apertures between same and the shaft seal to the motor, and cause the motor to get damaged.
3. The motor will also be damaged by the high temperature caused by the racing thereof due to lack of water.

SUMMARY OF THE INVENTION

Therefore, it is a main object of the present invention to provide a device to a pump that can dissipate heat and cut off power automatically when the motor of the pump has been racing to cause a high temperature due to lack of water.

The device for dissipating heat and cutting off power of a pump in the present invention includes a heat dissipating ceramics ring and a power cutting-off member.

The ceramics ring is tightly fitted in a pivoted hole of a plastic member. The pump has a motor with a shaft passing through a shaft seal to connect a main blade wheel provided for pumping water. The shaft seal is fitted in the ring from a front end portion, and fitted in the plastic member to form a watertight connection. The ceramics ring has an annular trench forming between an outer and an inner annular portions for increasing contact area of both of the annular portions with water so that the ring can dissipate heat more rapidly. Thus, the plastic member is protected from getting melted by heat from the motor.

The power cutting off device is connected to the motor, and has a sensing element disposed in contact with the ceramics ring to sense a temperature of same for activation of the power cutting-off member when a racing of the motor occurs to cause temperatures of both the motor and the ceramics ring rising.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
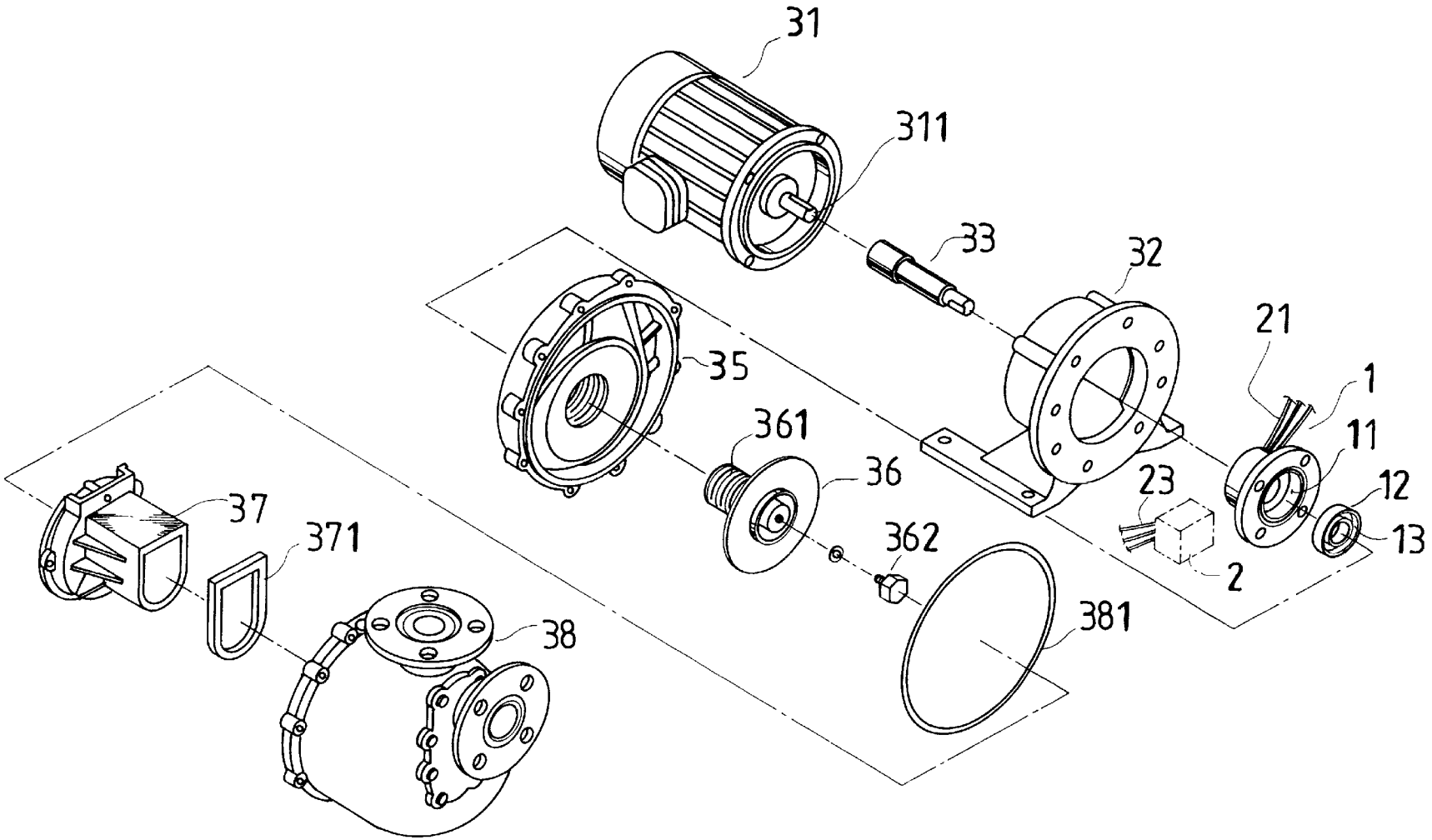
FIG. 1 is an exploded perspective view of a pump with the heat dissipating and power cutting-off device of the present invention.
Figure 2:
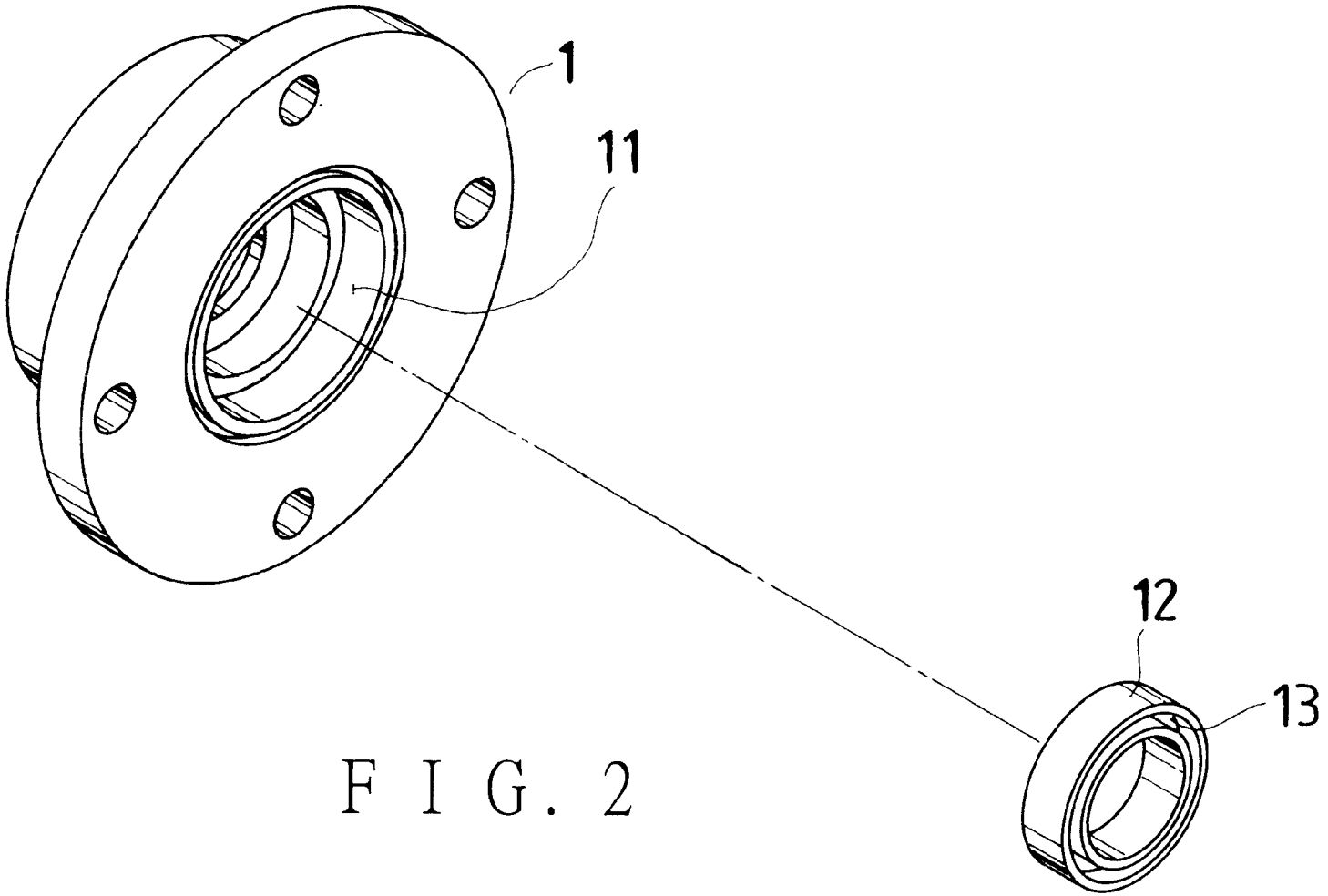
FIG. 2 is a perspective view of the heat dissipating ceramics ring according to the present invention and the plastic member.

Referring to FIG. 1, a pump having the heat dissipating and power cutting-off device of the present invention includes a motor 31, a main shaft 33, a fixing member 32, a protecting covering 1, and the heat dissipating and power cutting off device, which has a heat dissipating ceramics ring 12 and a power cutting member.

The motor 31 has a shaft center 311 sticking out on the center of the front end. The main shaft 33 is connected to the shaft center 311 so that it can turn together with the shaft center 311 when the motor 31 is running. The motor 31 is fixedly connected to one side of the fixing member 32 that is stationary. The protecting member 1 is fixedly connected to the fixing member 32, and has a pivotal hole 11 and a through hole 14 (FIG. 3) communicating with both the pivotal hole 11 and outside. The protecting member 1 is made of soft plastic materials.

Figure 3:
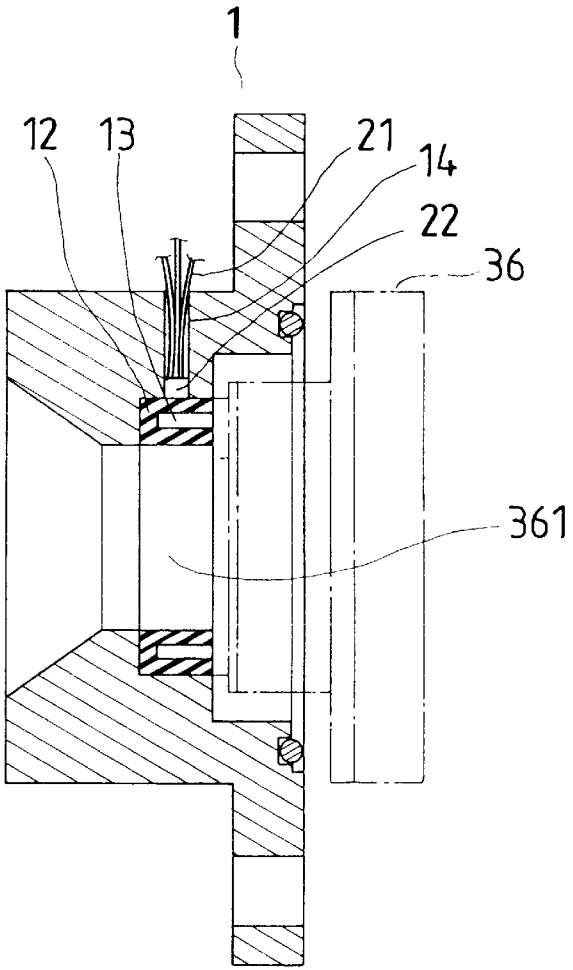
FIG. 3 is a cross-sectional view of the heat dissipating ceramics ring of FIG. 2 and the related parts.
Figure 7:
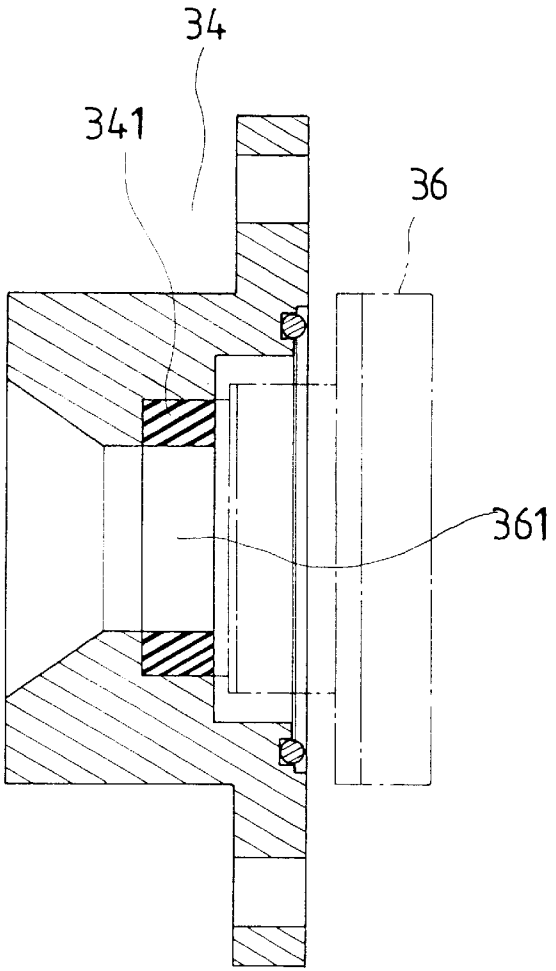
FIG. 7 (PRIOR ART)
FIG. 7 is a cross-sectional view of the ceramics ring and the plastic member of the conventional pump in FIG. 5.

The ceramics ring 12 has two annular portions, the outer one being disposed around the inner one so that an annular trench 13 forms between both of the annular portions. The ceramic ring 12 has relatively good conductivity and heat resisting ability. Referring to FIG. 3, the ceramics ring 12 is tightly passed into the pivotal hole 11 of the protecting member 1, and abuts the bottom of the through hole 14 of the protecting member 1.

The power cutting-off member 2 includes sensing wires 21, a sensing element 22 (FIG. 3) and controlling wires 23.

The sensing wires 21 are connected to the sensing element 22, and the sensing element 22 is disposed at the lower end of the through hole 14 to get into contact with the ceramics ring 12. The sensing wires 21 are connected to the main body of the powers cutting-off member 2 from the other ends. The controlling wires 23 are connected to the main body of the member 2 and the motor 31. The circuit of the power cutting-off member 2 is known by those skilled in the art, and not the subject of the present invention, so it is not detailed here.

The pump further has a rear sealing cover 35, a shaft seal 361, a main blade wheel 36, a screw 362, an O-shaped ring 381, a middle cover 37, a single phase valve 371 and a main body 38 like the conventional pump in the Background. The rear sealing cover 35 is fixedly connected to the other side of the fixing member 32. The main blade wheel 36 is disposed next to the front side of the rear sealing cover 35. The shaft seal 361 is passed through the rear sealing cover 35 and the main blade wheel 36, and is tightly fitted into the protecting member 1 and the ceramics ring 12 as shown in FIG. 3. The main shaft 33 is connected to the main blade wheel 36 by the screw 362 to pass on movement to the same. The middle cover 37, the single phase valve 371, the O-shaped ring 381 and the main body 38 are fitted in position like those of the conventional pump so the positioning thereof is not described again here.

In using the pump with the heat dissipating and power cutting-off device of the present invention, the ceramics ring 12, having the annular trenches 13 between both of the annular portions to increase the contact area with air and water, can dissipate heat more rapidly than the conventional ceramic ring 12 in the Background to effectively prevent the plastic protecting member 1 from getting damaged by the heat produced by the motor 31. Furthermore, when the motor 31 races to cause a relatively high temperature due to lack of water, the large amount of heat will pass through the ceramics ring 12 to the sensing element 22 abutting the ring 12. Thus, the power cutting-off device 2 cuts off the power of the motor 31 when the sensing element 22 senses that the temperature of the ring 12 is higher than a certain amount, preventing both the plastic member 1 and the motor 31 from getting damaged by the high temperature.

When the pump has been running for a relatively long period of time to cause the temperature of the ceramics ring 12 to become higher than the certain amount without lack of water, the power cutting-off member 2 will also cut off the power of the motor 31.

Figure 4:
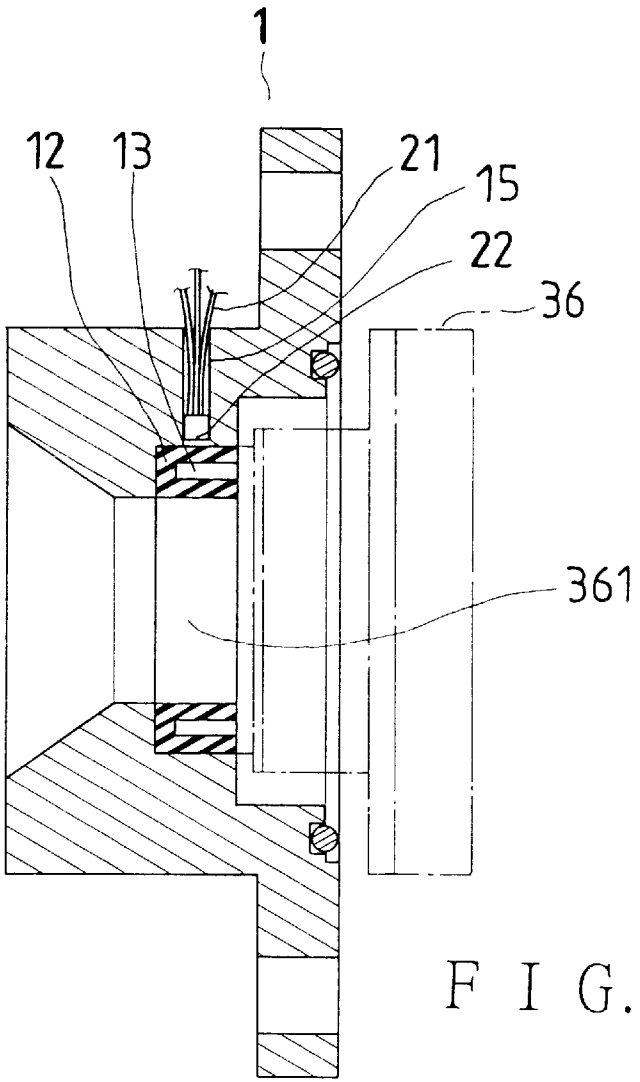
FIG. 4 is a cross-sectional view of the ceramics ring of FIG. 2 and the plastic member according to another embodiment of the present invention.
Figure 5:
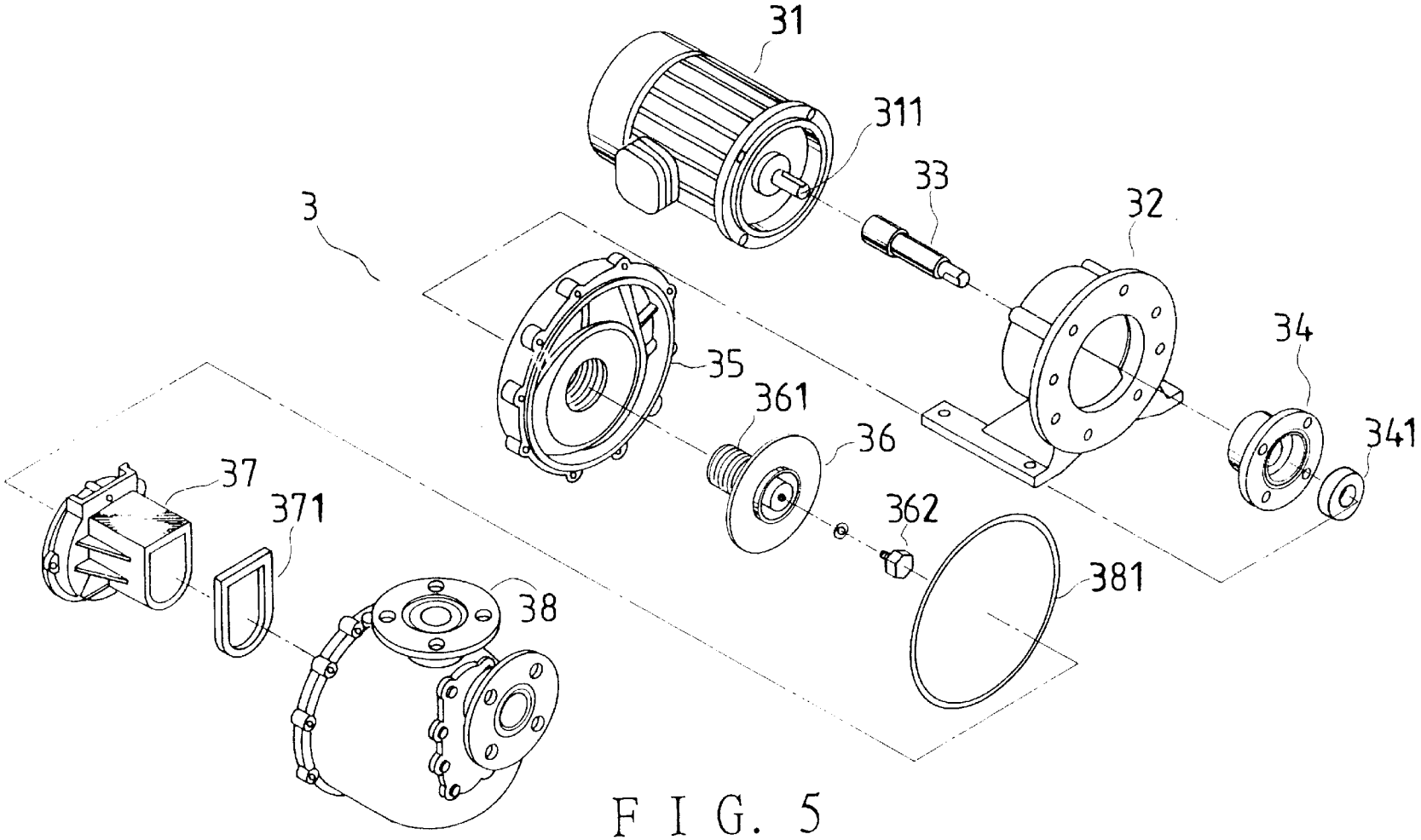
FIG. 5 (PRIOR ART)
FIG. 5 is an exploded perspective view of the conventional pump in the Background.
Figure 6:
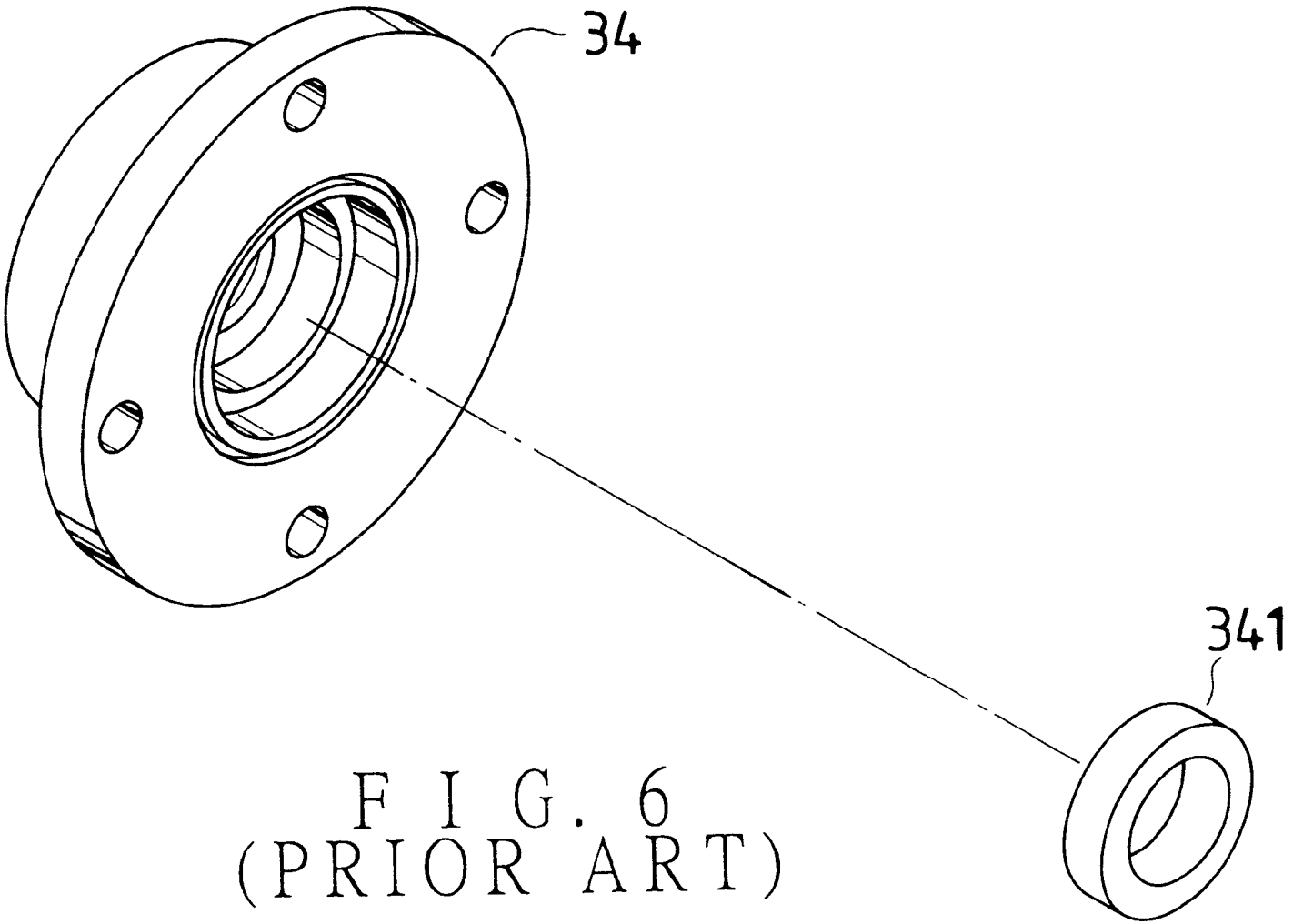
FIG. 6 (PRIOR ART)
FIG. 6 is a perspective view of the ceramics ring and the plastic protecting member of the pump in FIG. 5.

Referring to FIG. 4, the protecting member 1 can be provided with a holding hole 15 instead of the through hole 14 for receiving the wires 21 and the sensing element 22.

From the above description, we can understand that the heat dissipating and power cutting-off device of the present invention has desirable features as follows:

1. The ceramics ring has more contact area with water or air than a common one because it is provided with the annular trench between the two annular portions, able to dissipate heat more rapidly to prevent the plastic protecting member connected thereto from getting damaged by high temperature resulting from the running of the motor.
2. The power cutting-off member can automatically cut off the power of the motor when the sensing element thereof senses that the temperature of the ceramics ring get higher than a certain amount, preventing the motor, the plastic protecting member and the related parts from getting damaged by the abnormally high temperature resulting from racing of the motor in lack of water.
3. The power cutting-off member also can cut off the power of the motor to prevent both the ceramics and the motor from getting damaged by high temperatures resulting from a too long period of running of the motor.

What is claimed is:

1. A heat dissipating and power cutting-off device of a pump, comprising a heat dissipating ceramic ring fitted in a pivotal hole of a plastic protecting member to form a watertight connection therebetween; said pump having a motor with a shaft passing through a shaft seal and being connected to a main blade wheel provided for pumping water; said shaft seal being fitted in said ceramic ring from a front end portion there of to form a watertight connection;

characterized by an annular trench formed between an outer annular portion of said ceramic ring and an inner annular portion within said outer annular portion for permitting both said annular portions to get into contact with water to dissipate heat passing through said ceramics from said motor.

2. A heat dissipating and power cutting-off device of a motor as claimed in claim 1 further having a power cutting-off member electrically connected to said motor; said cutting-off member having a sensing element disposed in contact with said ceramic ring to sense a temperature of same for activation of said power cutting-off member when a racing of said motor occurs which cause a temperature of both said motor and said ceramic ring to increase.

* * * * *